US006923663B2

(12) United States Patent
Oddsen et al.

(10) Patent No.: US 6,923,663 B2
(45) Date of Patent: Aug. 2, 2005

(54) TRIPLEX RECEPTACLE

(75) Inventors: Dennis Oddsen, Eatons Neck, NY (US); Steve Zacharevitz, Northport, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/245,159

(22) Filed: Sep. 17, 2002

(65) Prior Publication Data

US 2004/0052039 A1 Mar. 18, 2004

(51) Int. Cl.[7] ..... H01R 4/66
(52) U.S. Cl. ..... 439/107; 439/535
(58) Field of Search ..... 439/107, 535, 439/652

(56) References Cited

U.S. PATENT DOCUMENTS

| | | | | | |
|---|---|---|---|---|---|
| 3,327,277 | A | * | 6/1967 | Ramsing | 439/107 |
| 3,358,261 | A | * | 12/1967 | Gaines et al. | 439/107 |
| 3,441,896 | A | * | 4/1969 | Hawkins | 439/107 |
| 3,478,295 | A | * | 11/1969 | Grieshaber | 439/107 |
| 4,240,686 | A | * | 12/1980 | Kurbikoff | 439/107 |
| 6,443,746 | B1 | * | 9/2002 | Yu | 439/107 |

* cited by examiner

*Primary Examiner*—Gary Paumen
(74) *Attorney, Agent, or Firm*—Paul J. Sutton

(57) ABSTRACT

There is disclosed a single unit triplex receptacle having three sockets that can be mounted in a single box, does not require separate interconnecting wiring and can be covered by a single wall plate. There is also disclosed a single unit sixplex receptacle having six sockets that can be mounted in a double box, does not require separate interconnecting wiring and can be covered by a single wall plate.

9 Claims, 13 Drawing Sheets

FIG. 10A
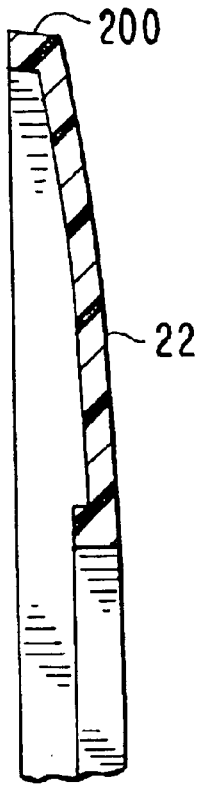
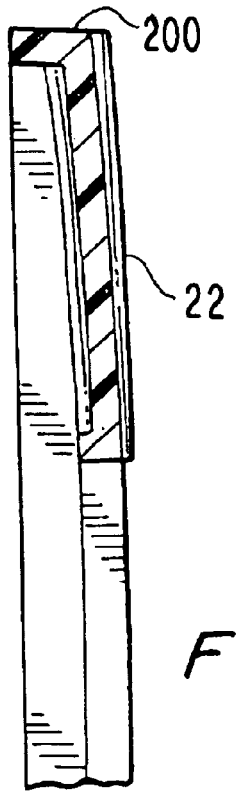
FIG. 10D
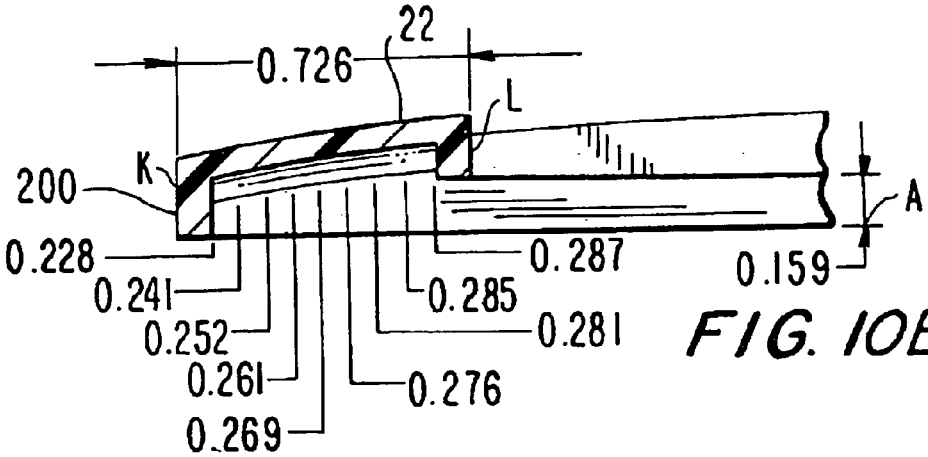
FIG. 10B
FIG. 10C
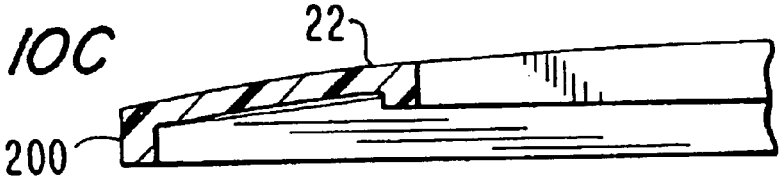

TRIPLEX RECEPTACLE

BACKGROUND OF THE INVENTION

1. Field of the Invention

The present invention relates generally to the field of wiring devices installed in boxes mounted in building walls and more particularly to a single unit triplex receptacle which can be placed in a standard single box; and, to a single unit sixplex receptacle which can be placed in two standard single boxes ganged together.

2. Description of the Prior Art

It is currently possible to mount a duplex receptacle in a single gem box. It is also possible to mount two duplex receptacles side by side in two boxes joined together or in an enlarged box which can accept two duplex receptacles. The two duplex receptacles must then be wired together to enable them to function as four receptacles. There is no single unit that can be mounted in a single box in a wall that can receive more than two plugs. Neither is there a single unit that can be mounted in a double box in a wall that can receive more than four plugs. A need exists for a single unit having more than two receptacles or sockets that can be mounted in a single box. A need also exists for a single unit having more than four receptacles or sockets that can be mounted in a double box and does not require separate interconnecting wiring.

SUMMARY OF THE INVENTION

There is disclosed a single unit triplex receptacle having three sockets that can be mounted in a single box, does not require separate interconnecting wiring and can be covered by a single wall plate. There is also disclosed a single unit sixplex receptacle having six sockets that can be mounted in a double box, does not require separate interconnecting wiring and can be covered by a single wall plate.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIGS. 10A–10D are views along 10A—10A through 10D—10D of FIG. 9;

DESCRIPTION OF THE PREFERRED EMBODIMENT

Figure 1:
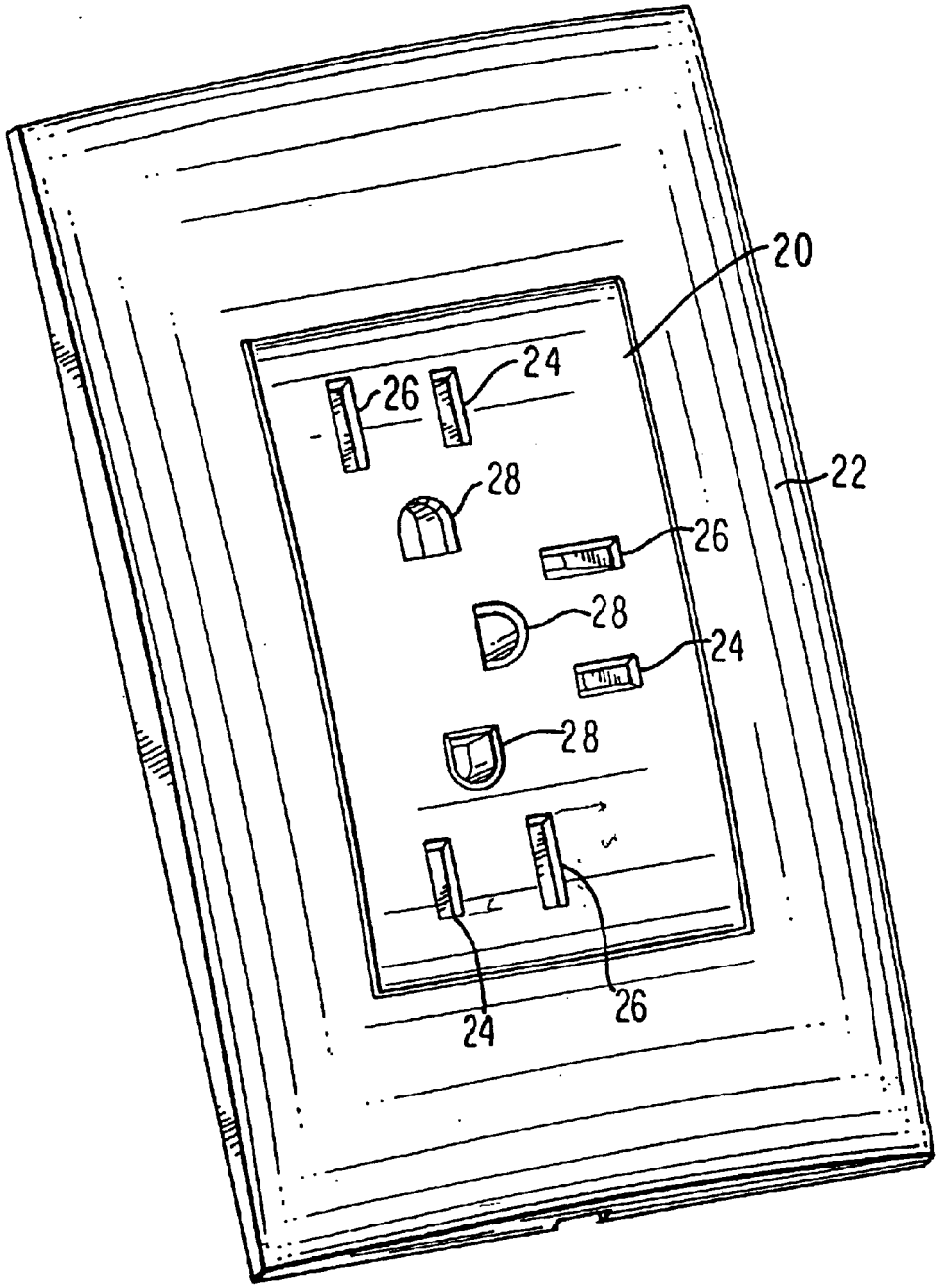
FIG. 1 is an isometric view of a single unit triplex receptacle which can be mounted in a single box and a wall plate in accordance with the principles of the invention.

Referring to FIG. 1, there is illustrated a triplex receptacle 20 located within a wall plate 22 in accordance with the principles of the invention. Triplex receptacle 20 is intended for 15 Amp. 125 V AC and according to NEMA specification 5-15R, where each individual receptacle has two slot openings 24 and 26 for receiving the flat blades of a suitable plug and a semi-circular ground blade opening 28. The opening 26 is larger than the opening 24 so that a two blade plug can only be inserted in one way to maintain the correct electrical polarization. The larger slot is connected to the neutral conductor and by maintaining the correct polarization, the external metal parts of appliances such as toasters, TV's etc. can be grounded through the neutral conductor. The presence of the semi-circular ground blade makes insertion with the wrong polarity impossible.

Figure 2:
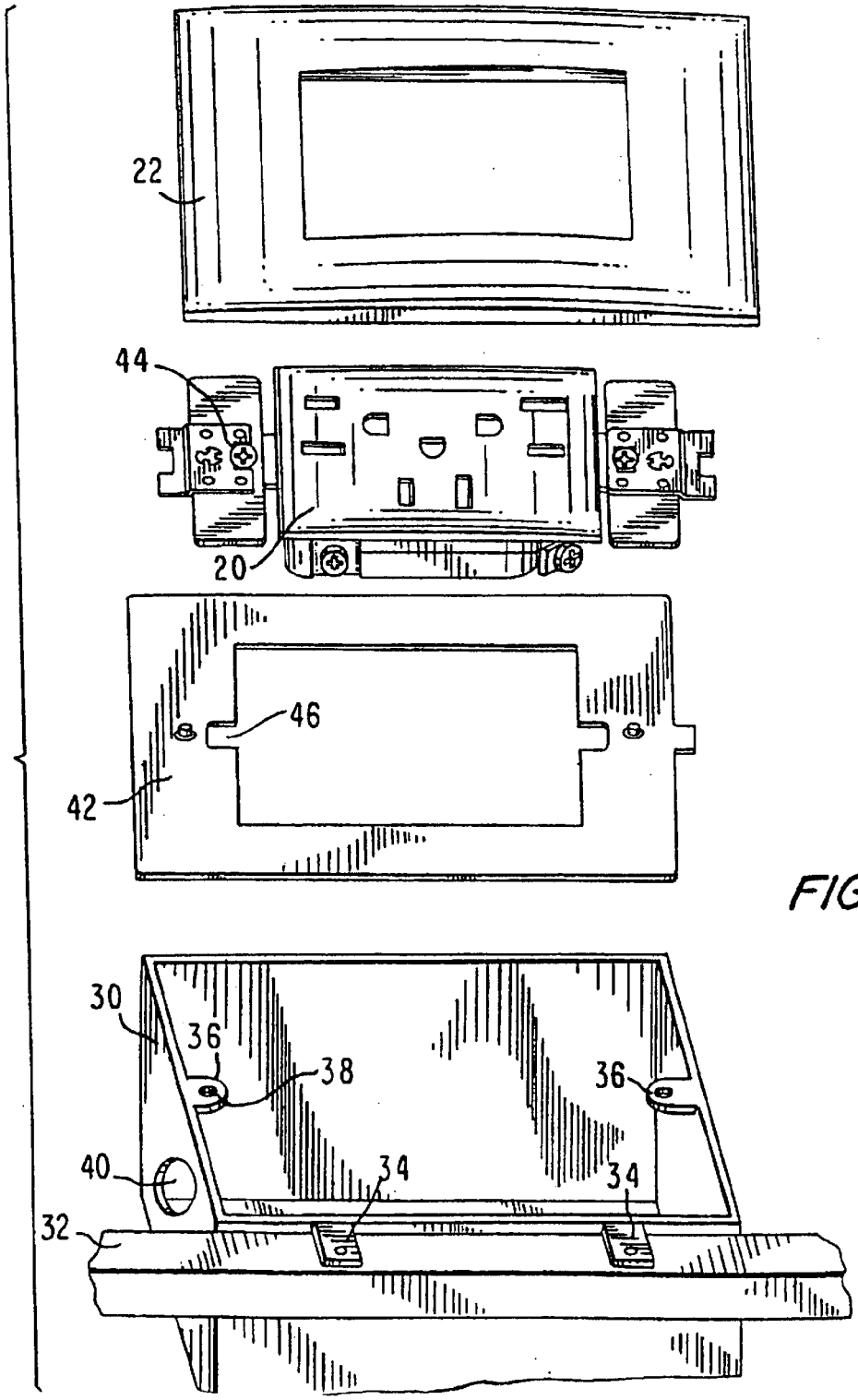
FIG. 2 is an exploded view of the single box, alignment plate, triplex receptacle and wall plate in accordance with the principles of the invention.

Referring to FIG. 2, there is shown an exploded view of a single box 30, a single unit triplex receptacle 20, an attachment plate 42 and cover plate 22. Initially, in the field, a suitable aperture is cut into a wall to provide access for mounting box 30 to a stud 32, or to permit installation of a suitable box to an adjacent stud or directly to the material of the wall (such as plasterboard). The box 30 is a single gem box. The box 30 is made of metal or plastic, has one or more openings in its sides or back to permit the introduction of electrical cables into the interior of the box 30 and has mounting means 34 to permit the box to be anchored to the adjacent stud 32. The box supports pairs of mounting ears 36. Each mounting ear contains a threaded aperture 38 to which can be fastened the mounting screws 44 of the triplex receptacle 20. In the normal order of assembly, electrical cables are passed through knock out openings 40 to the interior of the box. The ends of the electrical cables are stripped of insulation and attached to contacts on the side or rear of the body of the receptacle 20. After the electrical cables are attached to contacts on the side or rear of the body of the receptacle, the body of the receptacle is inserted into the alignment plate 42 and is then pushed into the box until the back of the alignment plate 42 touches the top of the box 30. The receptacle and the alignment plate are now attached to the box by means of screws 44 that pass through clearance openings such as elongated slots 46 in the alignment plate 42 and are threaded into openings 38 in ears 36. Thereafter, wall plate 22 is placed over the assembly of the receptacle 20, the alignment plate 42 and the box 30.

Figure 3:
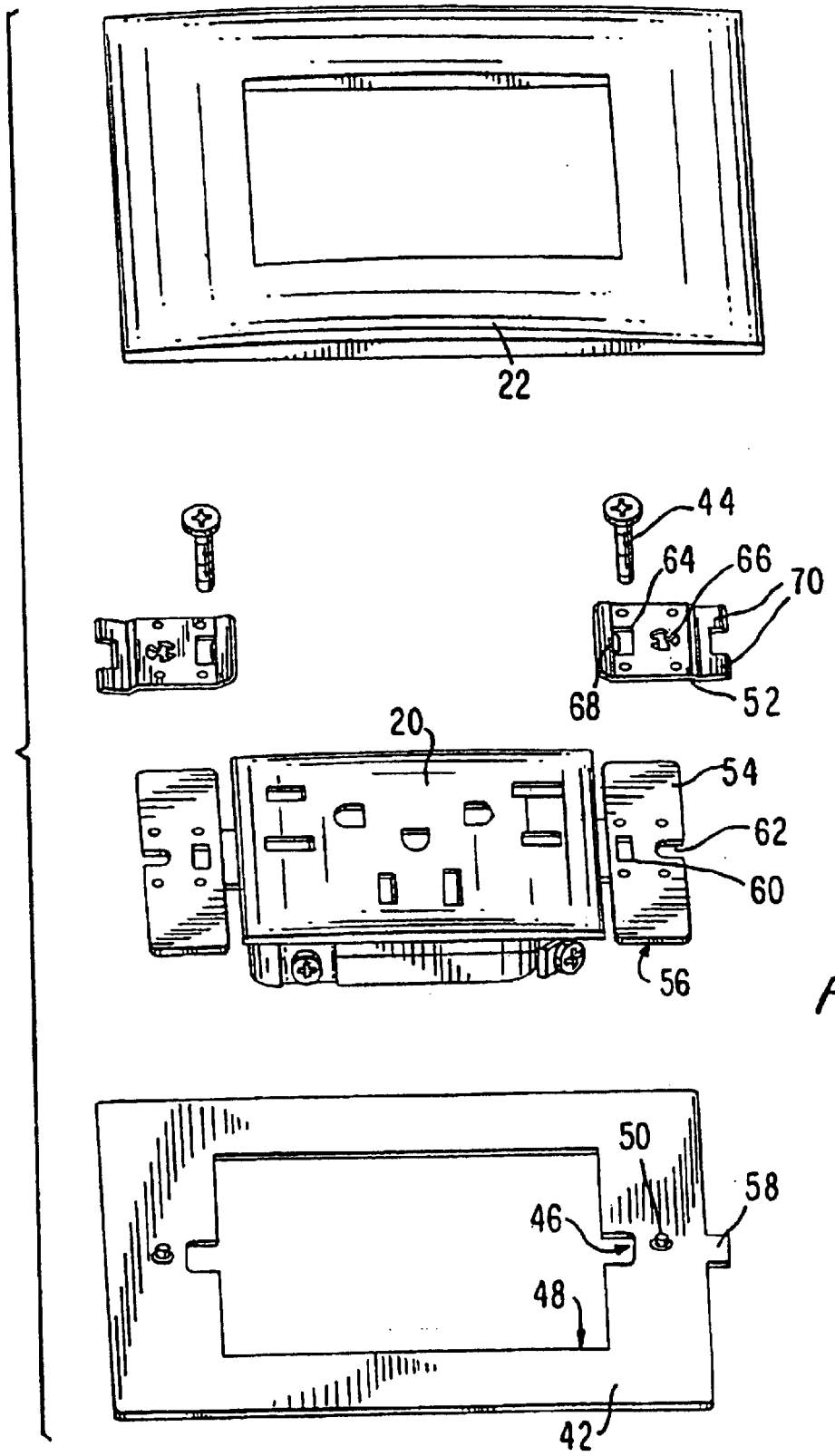
FIG. 3 is an exploded view of the alignment plate, triplex receptacle and wall plate illustrating in detail the captive member attached to the end of the ground strap of the receptacle.

Referring to FIG. 3, the alignment plate 42, which can be composed of metal such as cold rolled steel of the like, supports a centrally located rectangular opening 48 sized to accept the body of the receptacle 20. Centrally located at each end of the rectangular opening and contiguous with the opening 48 are two clearance openings 46 which provide clearance for mounting screws 44 which are used to secure the receptacle 20 and alignment plate 42 to the box. Located beyond the outer edge of each clearance opening 46 is an alignment pin 50. The alignment pins are provided to engage openings 66 located in captive members 52 which are attached to the ends or lugs 54 of the ground strap 56 by screws, rivets etc. Alignment plate 42 supports a tab 58 that projects outward from the lower end and is used to facilitate removal of a wall plate from around the receptacle. The outside dimensions of the alignment plate are such that it can extend beyond at least one dimension of the box to which the receptacle and plate is attached. It is to be noted that the alignment plate 42 illustrated in FIG. 3 is for the single unit triplex receptacle here disclosed.

Continuing with FIG. 3, there is illustrated a new improved single unit triplex receptacle 20 which can fit within a single box. Receptacle 20 supports a ground strap having a lug 54 at each end which is attached to captive members 52 by means of screws, rivets, spot welds or the like. Each lug 54 can be rectangular in shape and contains two openings 60, 62. Opening 60 is a clearance opening for mounting screw 44 which is normally provided by the manufacturer of the receptacle for attaching the receptacle to the box. The distance between centers of openings 60 in lugs 54 on the ground strap is equal to the distance between the centers of openings 38 in ears 36 of box 30 to allow mounting screws 44 in openings 60 to engage and be held captive by the threaded openings 38. Clearance openings 46 in the alignment plate 42 are clearance openings for mounting screws 44. Openings 62 in the lugs 54 are clearance openings for alignment pins 50 of alignment plate 42.

Continuing with FIG. 3, captive member 52 can be composed of phosphor bronze, spring brass, spring steel or the like and is securely attached to lugs 54. Captive member 52 contains a first opening 64 which is aligned with opening 60 in the lug and a second opening 66 which is aligned with opening 62 in the lug. Opening 60 can be oval, square or rectangular in shape to allow mounting screw 44 to be positioned off center. A centrally located projection 68 extends into opening 64 and is bent at a slight downward angle toward the body of the switch to engage and hold loosely captive the threaded body of mounting screw 44. Engagement of projection 68 with screw 44 provides a good electrical connection between the ground strap of the receptacle, the screw 44 and the box to insure that the receptacle is connected to ground. Screw 44, which passes through opening 64 of the capture member opening 60 of the lug and opening 46 of the alignment plate 42, threads into opening 38 of the box to hold the receptacle and alignment plate to the box. Openings 64 and 60 are sized to allow the screw 44 to move laterally to compensate for slight misalignments that may occur. Opening 66 in captive member 52 is substantially circular and supports three inwardly projecting members bent upward at a slight angle away from the receptacle body. The ends of the three projecting members form an opening slightly smaller than the diameter of alignment pin 50 on alignment plate 42 and are designed to flex slightly as the alignment pin is inserted into opening 66 from the rear. When the alignment pin is inserted into opening 66, the three ends of the projecting members frictionally engage and hold captive the alignment pin to prevent the easy removal of the alignment pin from the captive member. Located at the end of captive member 52 are two tabs 70. The end of each tab has a double bend similar to a 360 degree sine curve and are provided to hold the wall plate in place by engaging indents on the inside ends of the wall plate.

Figure 4:
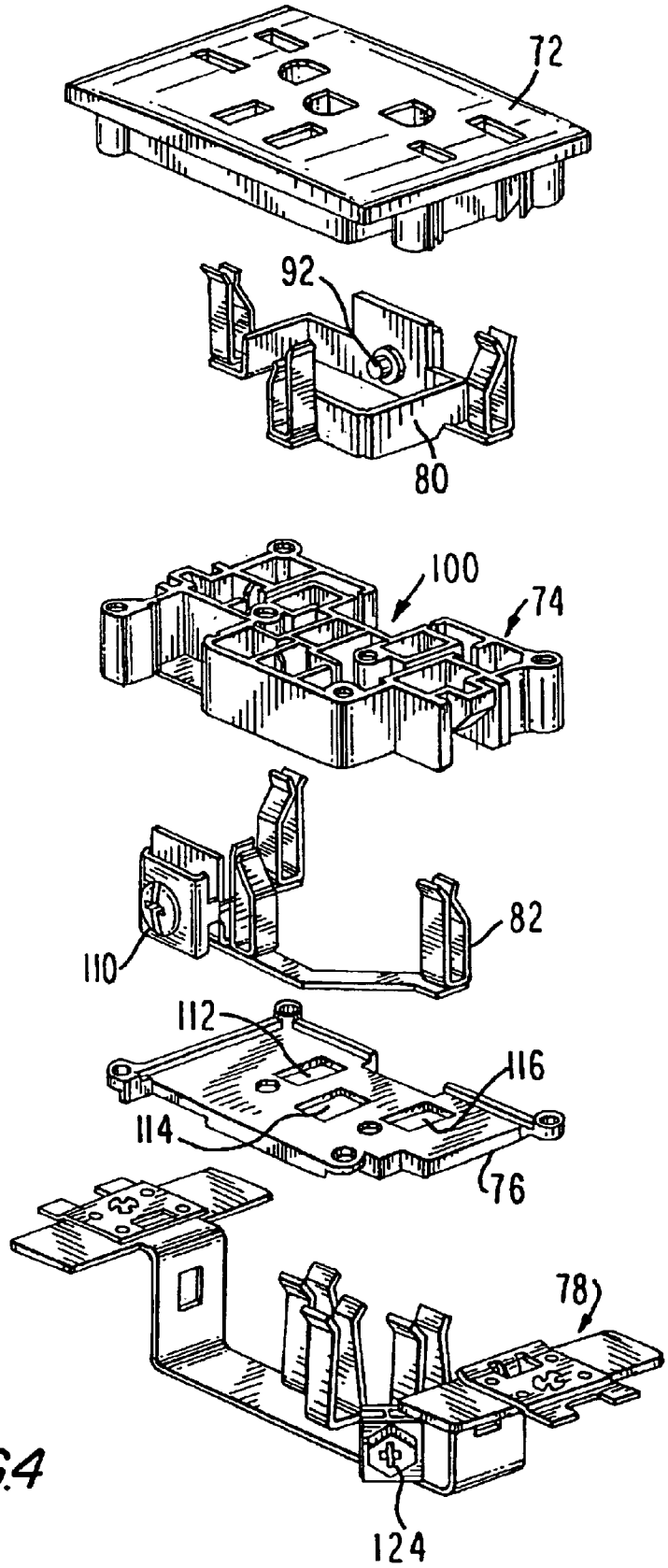
FIG. 4 is an exploded view of the triplex receptacle.

Referring to FIG. 4, there is illustrated an exploded view of the single unit triplex receptacle 20. Receptacle 20 has a top member 72, an intermediate member 74, a bottom member 76 and a ground strap 78. Positioned between the top member and the intermediate member is bus 80 having three contacts, one for each of the three receptacles, for receiving the flat blade of a plug which is to be connected to the neutral conductor. Positioned between the intermediate member and the bottom member is bus 82 having three contacts, one for each of the three receptacles, for receiving the flat blade of a plug which is to be connected to the phase conductor. Positioned below the bottom member 76 is the ground strap 78 having three ground contacts, one for each of the three receptacles, for receiving the ground blade of a plug.

Figure 5:
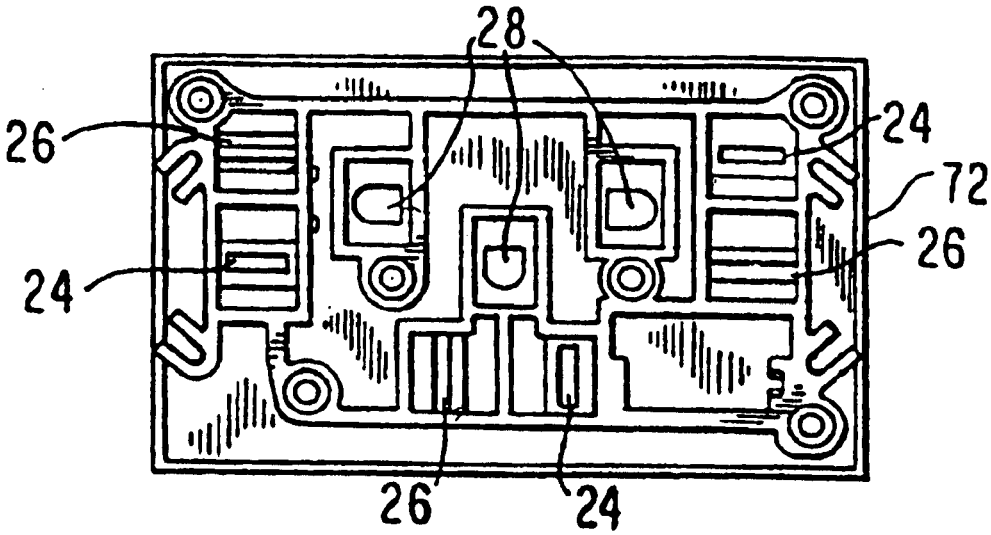
FIG. 5 is a view looking at the top member 72 from bus 80 as shown in FIG. 4.
Figure 6:
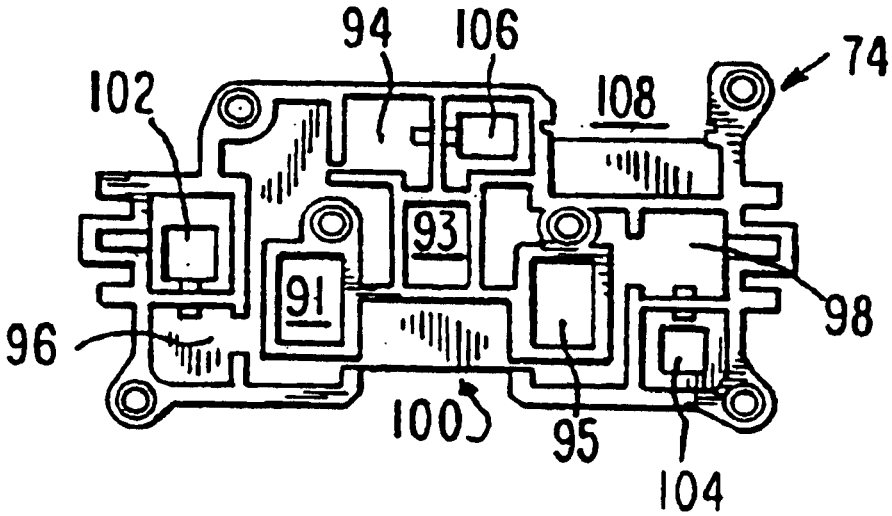
FIG. 6 is a view looking into the intermediate member 74 from bus 80 as shown in FIG. 4.
Figure 7:
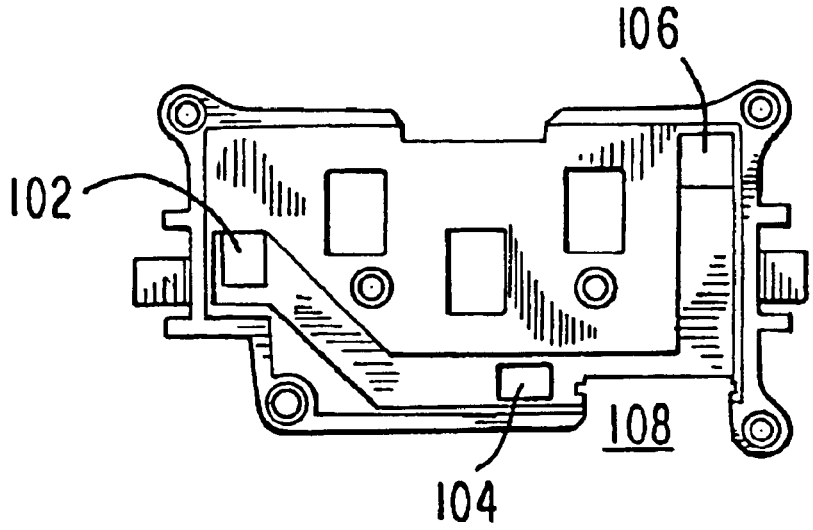
FIG. 7 is a view looking at the bottom of intermediate member 74 from bus 82 as shown in FIG. 4.
Figure 8:
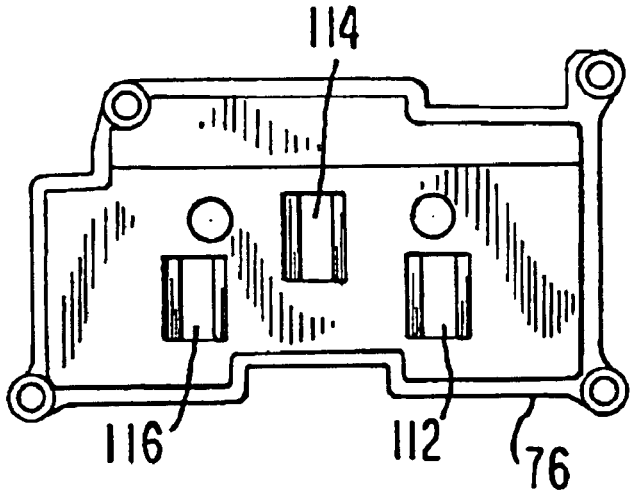
FIG. 8 is a view looking at the top of bottom member 76 from bus 82 as shown in FIG. 4.

FIG. 5 is a plan view of the bottom of top member 72 looking up from bus 80; FIG. 6 is a plan view of the top of intermediate member 74 looking down from bus 80; FIG. 7 is a plan view of the bottom of intermediate member 74 looking up from bus 82; and, FIG. 8 is a plan view of the bottom member 76 looking down from bus 82.

Returning to FIG. 4, bus 80 supports a terminal with a screw 92 for receiving the neutral wire conductor and three contacts for receiving flat blades of a plug. Intermediate member 74 is composed of insulating material having on its top surface various partitions selectively spaced to provide separate compartments some of which contain openings to provide a serpentine passageway for receiving bus 80. Bus 80 is shaped to follows a serpentine path around and thru the various partitions in the top of intermediate member 74 to position the commonly connected three contacts in compartments 94, 96, 98 and screw terminal 92 in opening 100 (see FIG. 6). Referring to FIGS. 5 and 6, when intermediate member 74 is assembled to top member 72, the three contacts of bus 80 are located in compartments 94, 96, and 98 of intermediate member and below the openings 26 of each of the three receptacles in the top member. Referring to FIG. 6, the bottom surface of intermediate member 74 is substantially flat and supports openings 102, 104, and 106 for receiving contacts of bus 82 from the bottom of the member. Intermediate member 74 also contains thru openings 91, 93 and 95 for receiving ground contacts on the ground strap 78. Bus 82 supports a screw terminal 110 for receiving a wire conductor. Bus 82 follows a serpentine path along the flat bottom surface of intermediate member 74 to position the commonly connected contacts in openings 102, 104, and 106 and screw terminal in opening 108. Bus 80 is electrically isolated from bus 82 by the insulating bottom surface or floor of intermediate member 74.

Bottom member 76 is adapted to be attached to the bottom of intermediate member 74 and supports openings 112, 114 and 116 (FIG. 4) for receiving ground contacts. Referring to FIG. 4, when the top, intermediate and bottom members are assembled together, openings 116, 114 and 112 in the bottom member are aligned with openings 95, 93 and 91 respectively (FIG. 6) in the intermediate member to position the ground contacts behind the ground openings 28 (FIG. 5) in the top member. In a similar manner, when the receptacle is assembled, openings 104, 106 and 102 are aligned with openings in the top member to position the contacts of bus 82 beneath openings 26 in the top member. Ground strap 78 is composed of conductive material such as iron or steel and is electrically connected to and supports three ground contacts. Ground strap 78 also supports screw terminal 124 for connecting the receptacle ground contacts to an electrical ground.

To assemble the triplex receptacle, the bus 80 and its contacts are placed in the top of intermediate member 74, the bus 82 and its contacts is placed on the bottom of intermediate member, and the intermediate member is then assembled to top member. The bottom member 76 is then positioned next to the bottom of intermediate member over the bus 82 and the ground strap is coupled to the assembled parts. In the assembled receptacle, the contacts which are located behind the openings 24 of each socket are connected to a common bus; the contacts located behind openings 26 of each socket are connected to a common bus; and the contacts located behind the openings 28 of each socket are connected to the ground strap of the receptacle.

To connect the single unit receptacle having three sockets to a box, the electrical cables in a box are stripped of insulation and are attached to terminals on the side or back of the receptacle. The alignment plate is then attached to the receptacle from the back. Initially, after the wires are attached to the receptacle, the alignment plate is held vertically in front of the receptacle and parallel to the receptacle. The top of the receptacle is now tilted downward from its vertical position until it is horizontal and, while in its horizontal position, the end of the receptacle that was initially up is passed through opening 48 of the alignment plate which is in its vertical position. After the receptacle is passed completely through the opening of the alignment plate, the receptacle is tilted back to its initial vertical position. At this time the alignment plate and the receptacle are now moved toward each other until the front face of the alignment plate contacts the back face of the lugs 54 on the ends of the ground strap. As the alignment plate approaches the lugs, alignment pins 50 of the alignment plate pass thru openings 62 in the lugs and enter openings 66 in captive members 52. As the alignment pins enter the openings 66, they force the upwardly bent projections to spread apart to allow the alignment pins to fully enter openings 66. The ends of the upwardly bent projections engage and hold captive the alignment pins 50. The receptacle, which is now attached to the alignment plate and is connected to the electrical wires, is inserted into the box. As the receptacle is inserted into the box, screws 44 located in openings 64 of the captive member and clearance opening 46 in alignment plate are aligned with and threaded into openings 38 of the box to hold both the alignment plate and receptacle to the box. The head of screw 44 is larger than opening 64 and 60 and, therefore, holds receptacle 20 and alignment plate 42 captive to the box.

The wall plate is now placed over the receptacle. Referring to FIG. 3, each captive member 52 supports at least two projecting latching pawls 70. Each pawl has a double curve similar to a three hundred sixty degree sine curve. After the receptacle 20 is attached to the alignment plate 42, the two latching pawls 70 of captive member 52 are located on either side of a tab 58 on the alignment plate. Tab 58 functions as a tool pivot point to allow an attached wall plate 22 to be removed from around the receptacle. A slot in the lower edge of the wall plate 22 provides access for the insertion of a small flat tool such as a screw driver to facilitate removal of the wall plate from the receptacle.

Figure 9:
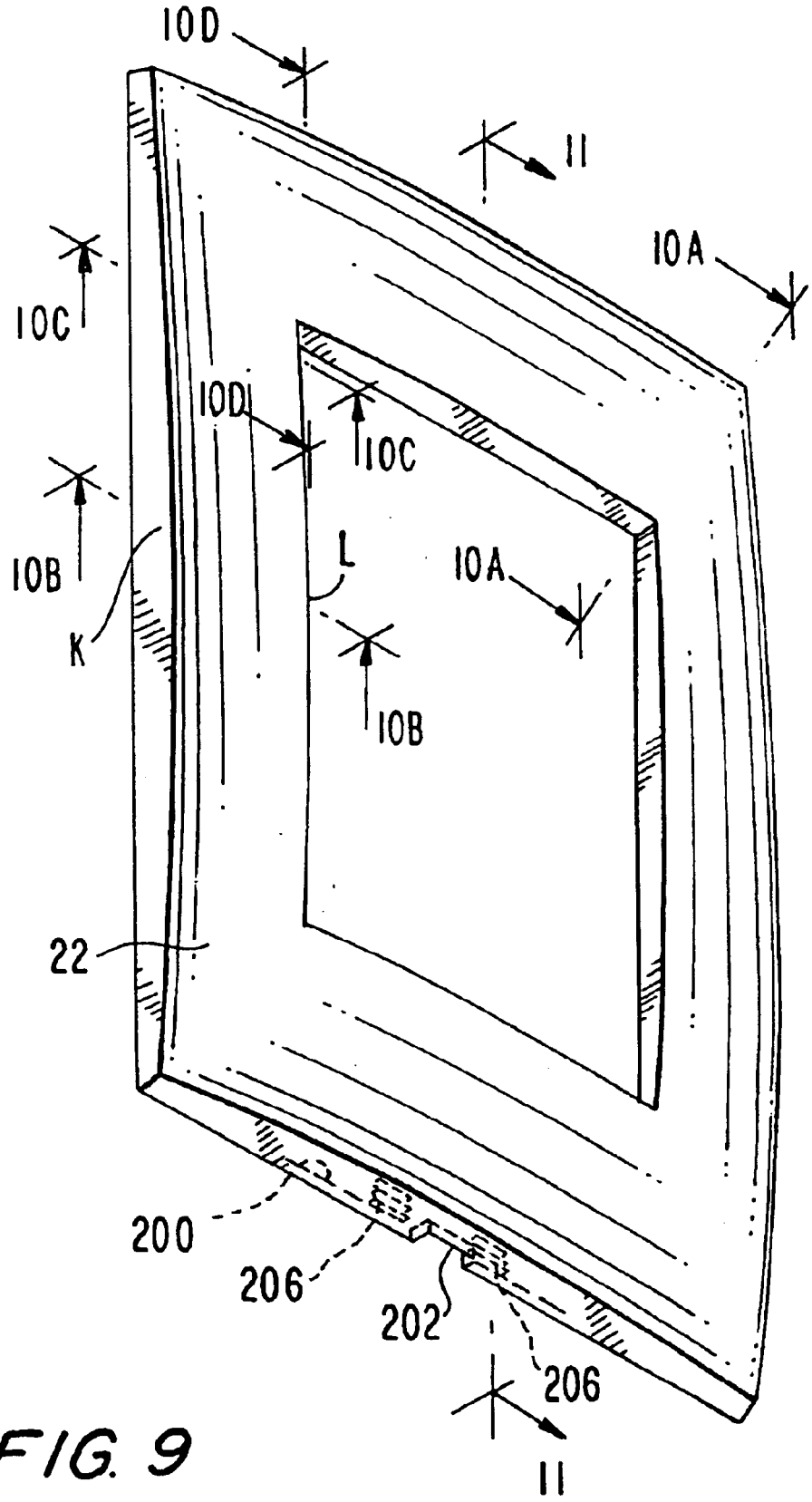
FIG. 9 is a front perspective view of the wall plate.
Figure 11:
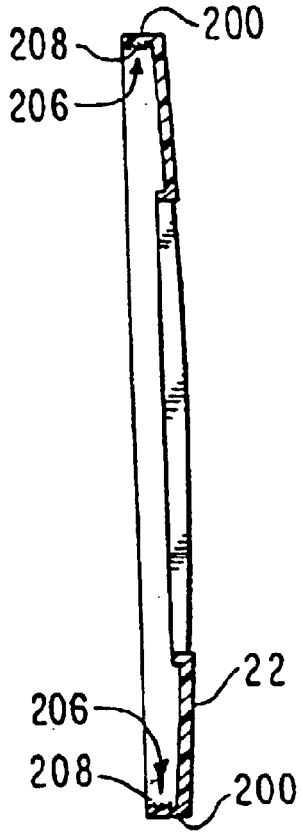
FIG. 11 is a side sectional view of the wall plate taken along the line 11—11 of FIG. 9.
Figure 12:
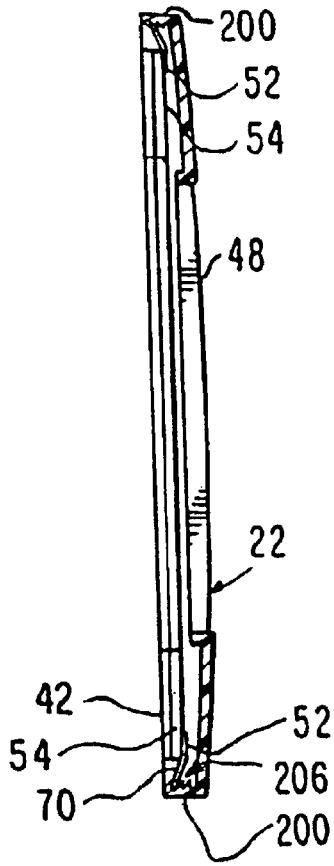
FIG. 12 is a side sectional view of the wall plate of FIG. 9 installed on a ground strap and alignment plate.

The width of the face of the single unit receptacle having three sockets is approximately 60% of the width of the wall plate (see FIG. 9) along the horizontal axis and approximately 53% of the length of the wall plate along the vertical axis. For the triplex receptacle, the wall plate is substantially 4.92 inches in length by 3.28 inches in width and has a rectangular opening for receiving the receptacle that is substantially 2.82 inches in length by 1.83 inches in width. The width of the wall plate varies depending upon how many boxes are ganged together and the number of triplex receptacles that are to be located in side-by-side relationship in boxes that are ganged. The front surface of the wall plate has a complex contoured shape where the edge of the wall plate at the rectangular opening for a triplex receptacle is further from the wall than the outer edge of the cover plate. More specifically, referring to FIG. 10, there is illustrated a view along the line 10B—10B of FIG. 9 of a portion of the front surface, along the horizontal centerline, between point K, the outer left edge, and point L, the inner edge of the opening for the receptacle. As illustrated in FIG. 10B, the surface lies between two profile boundaries 0.002 inches apart, perpendicular to datum plane A, equally disposed about the true profile and positioned with respect to a datum plane. The basic dimensions and the profile tolerance establish a tolerance zone to control the shape and size of the surface. The surface is 0.726 inches in length. Within that length, a contour is defined by the dimensions of equidistant points which are 0.0726 inches apart. Each dimension indicates that point's distance to define datum plane A, the back (flat) surface of the wall plate, which begins at point K. Moving from left to right, the dimensions increase from 0.228 to 0.287 inches. This progression indicates a contour of increasing height, positive first differential, when the points are connected by individual splines. The points are not connected by a single arc and the rate at which the contour height increases is not constant. The rate of height increase of the individual splines decreases from left to right, and the second differential of the contour is negative. That is, the difference between the first point's distance dimension and the second is larger than the difference between the second and the third, etc. Thus, the surface has a contour of positive first differential and negative second differential, comprised of a combination of splines drawn between points of varying distance from a datum plane. This description substantially describes most of the wall plate's contours for sections along lines 10A—10A, 10D—10D and 10E—10E of FIG. 9. Section along line 11—11, which runs along the vertical centerline of the wall plate defines a surface having a positive first differential and zero second differential, comprised of a combination of splines drawn between points of varying distance from a datum plane. This contour has zero second differential because the rate of height increase of the individual splines is constant; the difference between any two sequential point dimensions is at a uniform spacing of 0.0037 inches.

The contour along the width of the front of the triplex receptacle face is flat and the contour along the length of the triplex receptacle has a constant radius of substantially 30.724 inches. The shape of the front of the receptacle face allows for the proper seating of an inserted plug. The wall plate has no exposed mounting screws or other visible metal hardware. When the wall plate is attached to the receptacle, the only visible parts are the wall plate 22 and the receptacle.

Figure 13:
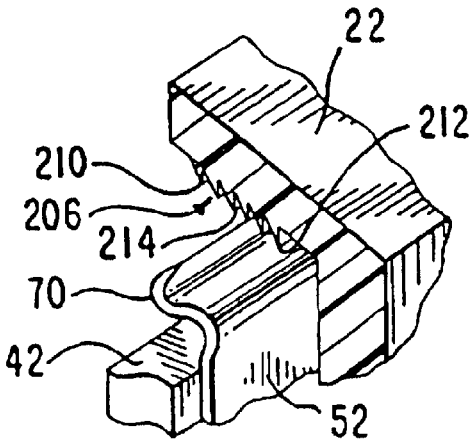
FIG. 13 is a fragmentary enlarged side elevation of the latching pawl of the captive member engaging the saw-tooth rack of the wall plate.
Figure 14:
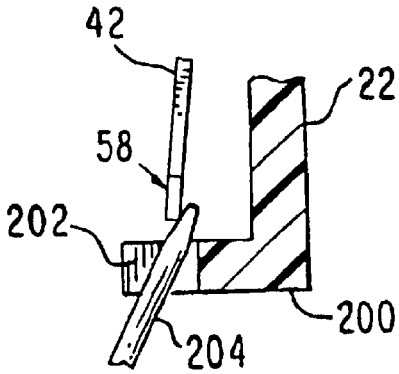
FIG. 14 is a fragmentary, enlarged side elevation in section of the wall plate and tab of the alignment plate to indicate how the two components can be separated following latching.

Referring to FIGS. 11–14, placed in the bottom end wall 200 of wall plate 22 is a slot 202 which provides access to the tab 58 on the alignment plate as seen in FIG. 14. A small, flat tool blade such as a screw driver blade 204 is moved through slot 202 in end wall 200 to contact both the outer surface of tab 58 and the back wall of slot 202. By moving the blade 204 in a counterclockwise direction using the back wall of slot 202 as a fulcrum, the force applied to tab 58 will separate wall plate 22 from the receptacle. To attach wall plate 22 to the receptacle, the pawls 70 of captive member 52 are made to engage saw-tooth shaped racks 206 located on the inner surfaces of the end walls 200 of wall plate 22. There are two racks on the top and bottom end walls 200. Each rack 206 contains a number of saw-tooth shaped teeth 208 each having an inclined front face 210 and a vertical back face 212. As seen in FIG. 13, as latching pawl 70 engages the inclined front face 210, the pawl deflects in a counterclockwise direction and moves past the tip of the first tooth 214. Once pawl 70 is past the tip of tooth 214, it can return to its initial position and take a position between the vertical back face 212 of first tooth 214 and the inclined front face 210 of a second tooth 214. This operation can be repeated as many times as needed to position the bottom edges of wall plate 22 as close to the wall as possible. Since each of the racks 206 and pawls 70 are independently operated, it is possible to locate the wall plate 22 to closely follow the wall contour, even when the wall is not flat. This ability to follow the wall contour is even more appreciated where the wall plate 22 is large, such as with a wall plate that is required to cover four ganged boxes where a receptacle is located in side by side relationship with switches.

Once the latching pawl 70 returns to its original position, any attempt to dislodge the wall plate 22 from the pawl 70 which is mechanically attached to the receptacle becomes difficult. However, since tool 204 can apply a great deal of force to tab 58, it is possible to separate the pawl 70 from engagement with the teeth and thus the receptacle from the wall plate.

Figure 15:
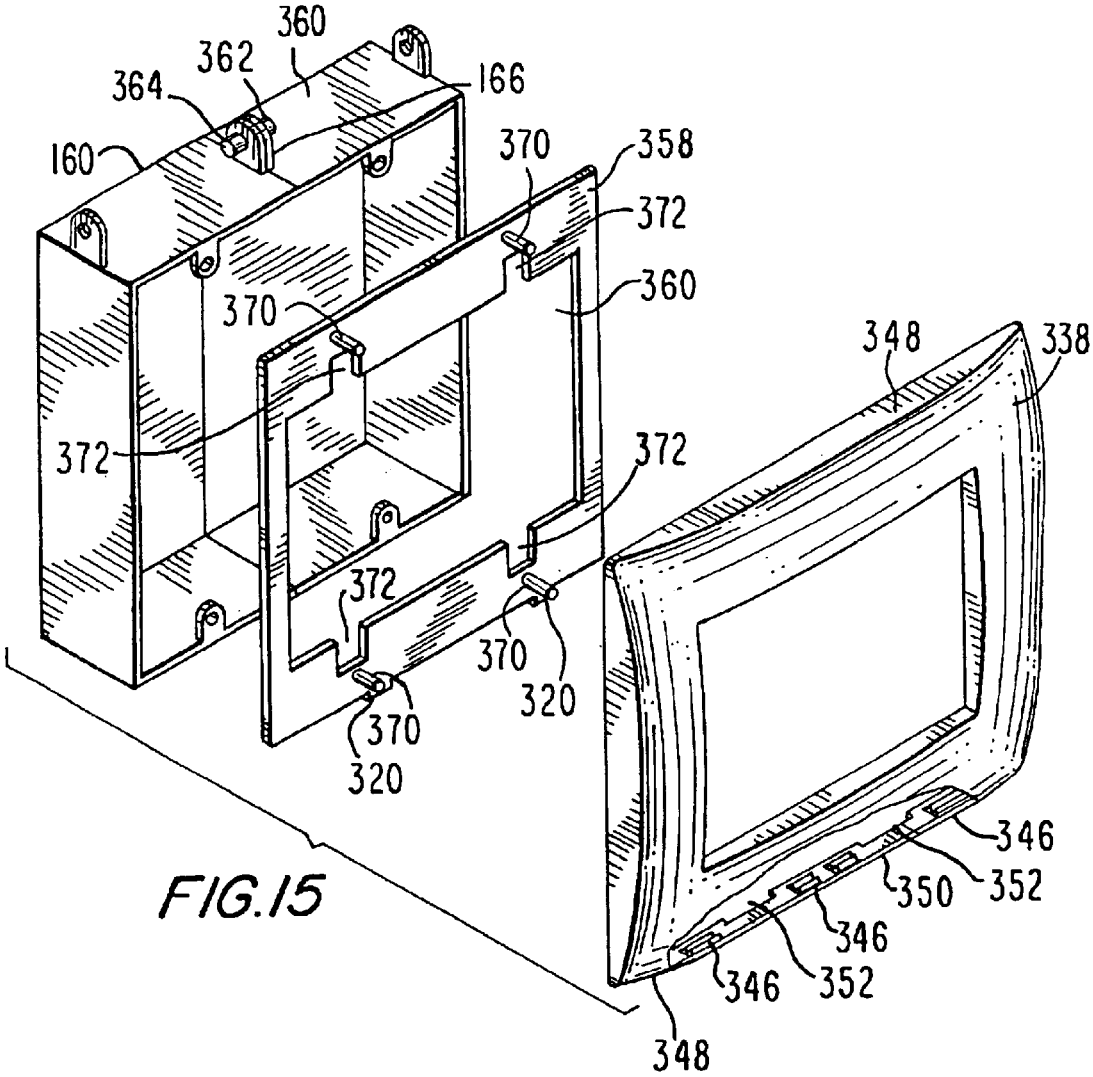
FIG. 15 is an exploded view of a ganged box, a wall plate and alignment plate for two triplex receptacles or a single sixplex receptacle.

Referring to FIG. 15, there is illustrated two boxes joined together to provide a double box, an alignment plate 358 and a wall plate for two triplex receptacles positioned side by side in the double box. It is to be noted that there is no partition or dividing member located in the wall plate opening to separate the two receptacles. The two triplex receptacles can be placed in the double ganged box 360 made up of two single ganged boxes and joined by fasteners 362 extending through the threaded apertures 364 of two joining ears. Alignment plate 358 has a single opening 360 for receiving two triplex receptacles, four clearance openings 372 and four alignment pins 370.

Looking at the wall plate 338, there can be three racks 346 on the interior of the top and bottom end walls 348 for receiving four pawls where the center rack is sized to receive one pawl from each receptacle. Also, there can be two tabs 320, one for each triplex receptacle, which will be accessible via slots 352 in the bottom end wall 348 of wall plate 338. Because of the independent operation of the pawls of the captive members with their respective racks 346, the wall plate 338 is able to compensate somewhat for lack of flatness of the wall around the receptacle.

Figure 16:
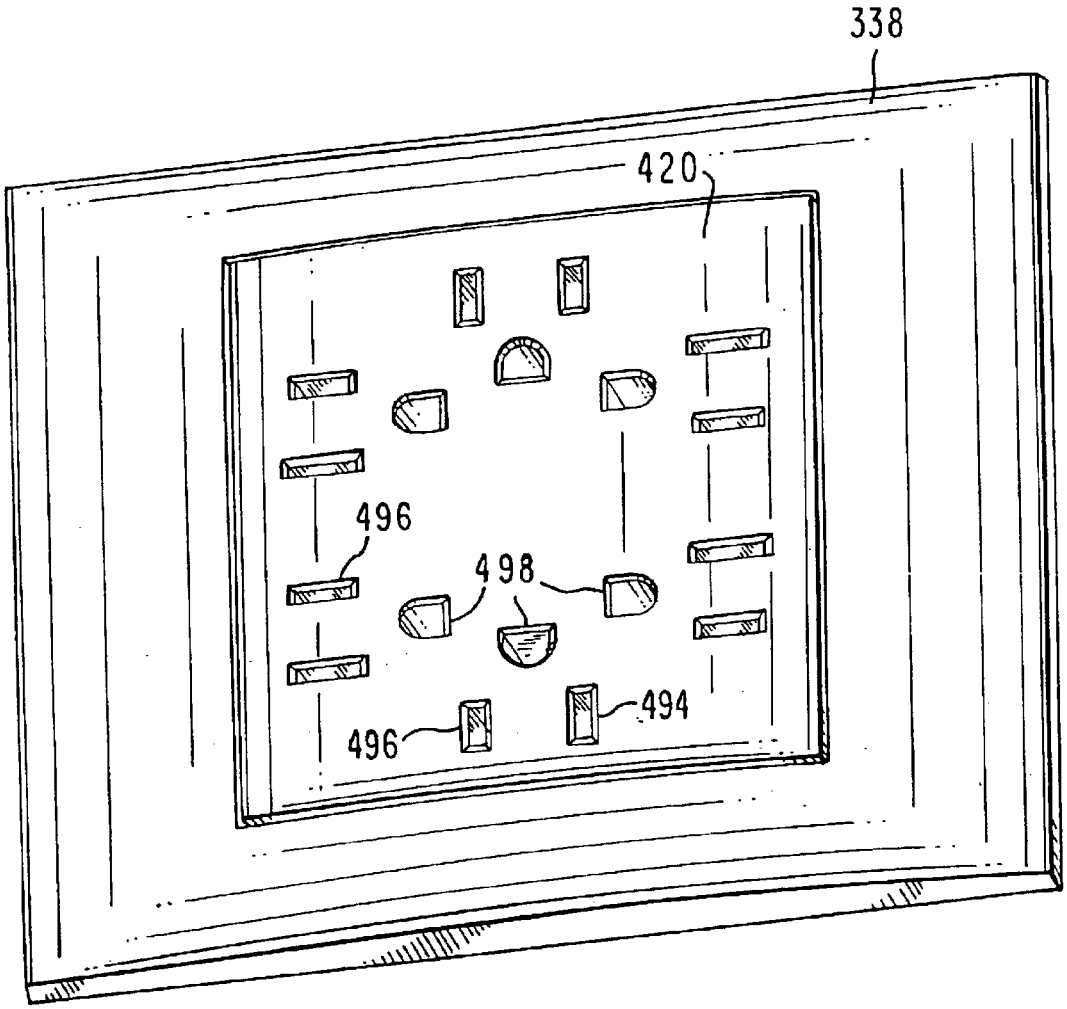
FIG. 16 is a view of a single unit sixplex receptacle and a wall plate.

Referring to FIG. 16, there is illustrated an isometric view of a single unit receptacle 420 having six sockets and wall plate 338 in accordance with the principles of the invention. As with the triplex receptacle, the sixplex receptacle 420 is intended for 15 Amp. 125 V AC and according to NEMA specification 5-15R, where each individual receptacle has two flat blade openings 494 and 496 for receiving the flat blades of a suitable plug and a semi-circular opening 498 for a ground blade. The opening 494 is larger than the opening 496 so that a two blade plug can only be inserted in one way to maintain the correct electrical polarization. The larger slot is connected to the neutral conductor and by maintaining the correct polarization, the external metal parts of appliances such as toasters, TV's etc. can be grounded through the neutral conductor. The presence of the ground blade makes insertion of a plug with the wrong polarity impossible.

Figure 17:
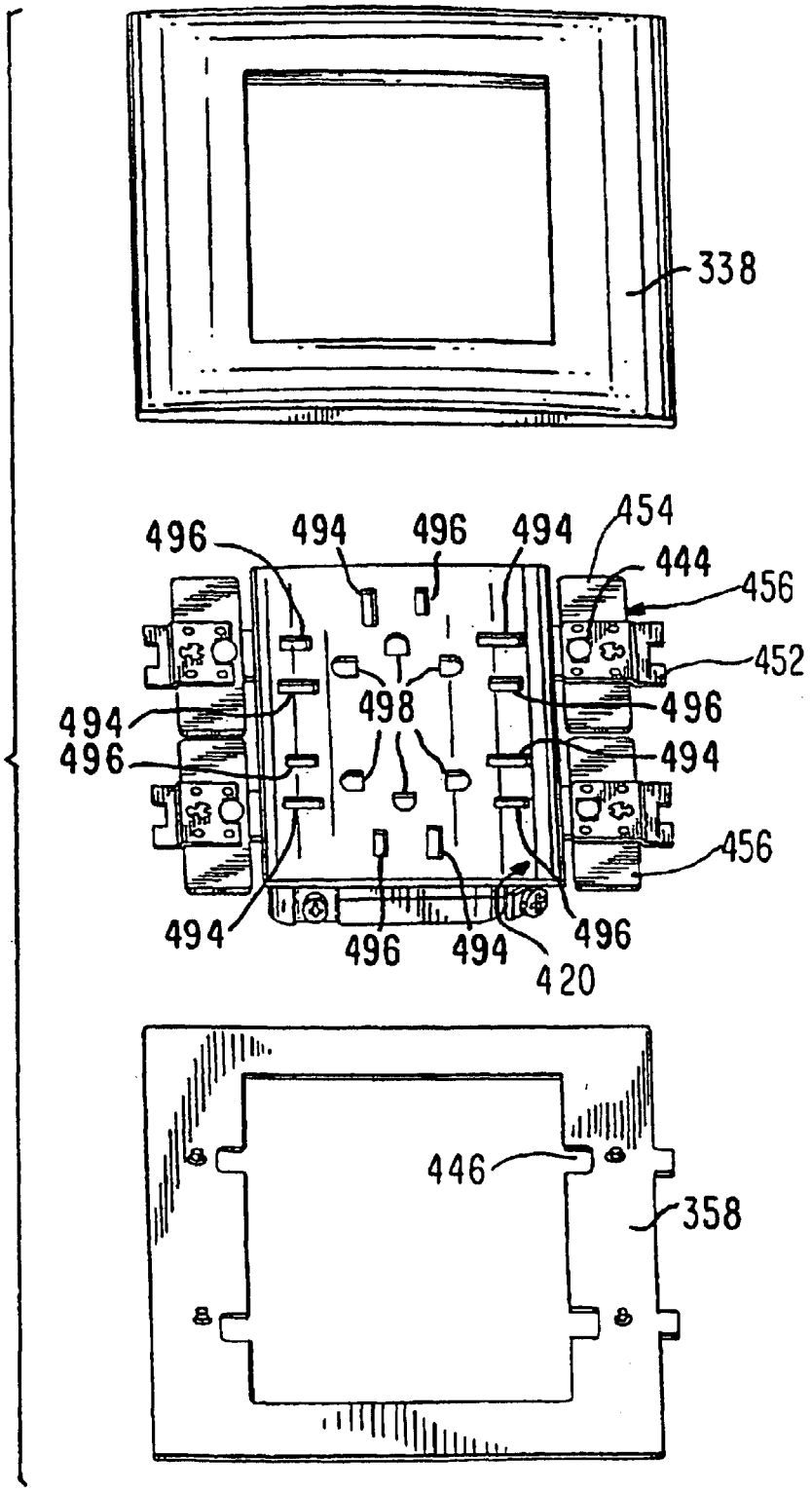
FIG. 17 is an exploded view of the alignment plate, a sixplex receptacle and a wall plate; and, FIG. 18 is an exploded view of the sixplex receptacle.

Referring to FIG. 17, there is illustrated an exploded view of the sixplex receptacle, and the alignment plate 358 and the wall plate 338 for the sixplex receptacle. Initially, during installation, a suitable aperture is cut into a wall to provide access for two boxes (see FIG. 15) joined together to form a single double size box mounted to a stud, or to permit installation of a suitable box to an adjacent stud or directly to the material of the wall (such as plasterboard). The double box consists of two single gem boxes joined together. The double box is large enough to accept a single unit sixplex receptacle having six sockets here disclosed. The box is made of metal or plastic, has one or more openings in its sides or back to permit the introduction of electrical cables into the interior of the box and has mounting means to permit the box to be anchored to an adjacent stud. The box supports pairs of mounting ears each having a threaded aperture to which is fastened the mounting screws of the receptacle 420. During assembly, electrical cables are passed through knock out openings to the interior of the box. The ends of the electrical cables are stripped of insulation and attached to contacts on the side or rear of the body of the receptacle 420. After the electrical cables are attached to contacts on the side or rear of the body of the receptacle, the receptacle is attached to the top side of the alignment plate 358, and the body of the receptacle is pushed into the box until the alignment plate 358 touches the top of the box. At this time, the receptacle and the alignment plate are attached to the box by means of screws 444 that pass through clearance openings such as elongated slots 446 and threaded into openings in ears of the box to mount receptacle 420 to the box. Thereafter, wall plate 338 is placed over the receptacle 420, the alignment plate 358 and the box.

Referring to FIG. 17, the alignment plate 358 and the wall plate 338 shown is for use with a single unit receptacle having six sockets and are similar to the alignment plate and wall plate shown in FIG. 15. Continuing with FIG. 17, there is illustrated a new improved single unit receptacle 420 having six sockets which can fit within a double box. The sixplex receptacle 420 supports two ground straps 456 each having a lug 454 at each end which provides support for captive members 452 by means of screws, rivets, spot welds or the like. Each ground strap 456 with its captive member 452 is similar to the ground strap and captive member shown in FIG. 3 and, therefore, in the interest of brevity, the details of their construction and operation will not again be repeated.

Figure 18:
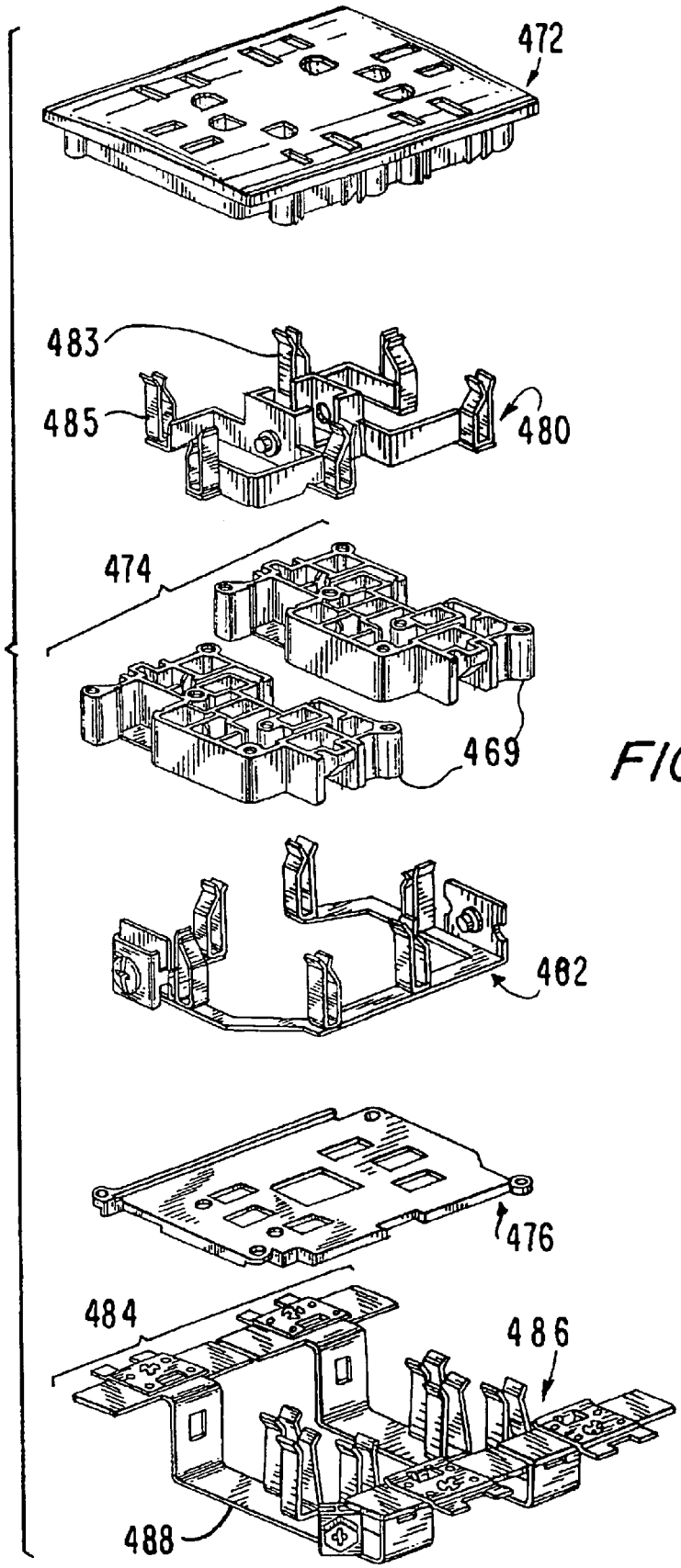

Referring to FIG. 18, there is illustrated an exploded view of a sixplex receptacle having a top member 472, intermediate member 474 consisting of two sections 469, which can be the same part rotated 180 degrees, a bottom member 476 and a ground strap 484 consisting of two sections 486 and 488. Positioned between the top member 472 and the two intermediate members 474 is bus 480 having six contacts, one for each of the six sockets in the top member for receiving the flat blade of a plug which is to be connected to a neutral conductor. Positioned between the two intermediate members 474 and the bottom member 476 is bus 482 having six contacts, one for each of the six sockets for receiving the flat blade of a plug which is to be connected to a phase conductor. Positioned below the bottom member 476 is the ground strap 484 consisting of two sections 486, 488 which are electrically connected together and support six ground contacts, one for each socket for receiving the ground blade of a plug which is to be connected to ground.

The top member 472 of the sixplex receptacle is a single structure having, on its top surface, six sockets each of which contains three openings, one for the phase blade, one for the neutral blade, and one for the ground prong of a plug. The top member of the sixplex receptacle can be considered to be two top members 72 of the triplex receptacle (see FIG. 4) joined together to form a single member. Thus, the bottom surface of the top member 472, looking up from bus 480 is similar to the bottom surface of two top members joined together to form a single unit and, thus, supports partitions selectively positioned to provide compartments which communicate with the openings of the various sockets in the top surface and provides passageways for accommodating the bus 480 having six contacts. Thus, the top member 472 of the sixplex receptacle can be considered to be two top members of the triplex receptacle shown in FIG. 4 positioned side by side and molded as a single unit. Continuing with FIG. 18, intermediate members 474 consists of two individual sections 469 each of which is similar to intermediate section 74 of the triplex receptacle shown in FIG. 4.

Bus 480 consists of two sections 483 and 485 electrically connected via a conductive bus with a common screw terminal where each section is similar to bus 80 of the triplex receptacle shown in FIG. 4. The bus is connected to six contacts for receiving the flat blades of a plug which are to be connected to the neutral conductor. Each section 469 of intermediate member 474 is similar to intermediate member 74 of the triplex receptacle and, thus, the top of each section 469 contains various partitions selectively spaced to provide a serpentine passageway for receiving the bus 480 having six contacts. More specifically, bus 480 follows a serpentine path around and thru the various partitions in the top of sections 469 to position the commonly connected contacts in openings which communicate with openings in the top member 472 designated to receive the flat blade of a plug which is to be connected to the neutral conductor 494. As with intermediate member 74, the bottom surface of each section 469 of intermediate member 474 is substantially flat and supports openings for receiving six contacts of the phase bus 482. Bus 482 can be considered to consist of two halves where each half is similar to bus 82 of the triplex receptacle shown in FIG. 4. The two halves of bus 482 are connected together by a conductive bridge and supports six contacts for receiving flat blades which are to be connected to the phase conductor. Bus 482 also supports two screw terminals either of which can be connected to the phase conductor. Bus 482 follows a serpentine path along the flat bottom surface of the two sections of intermediate member 474 to position the commonly connected contacts below openings in the member 470 designated to receive the flat blade of a plug which is to be connected to the phase conductor. Bus 480 is electrically isolated from bus 482 by the bottom surfaces of the two sections of intermediate member 474.

Bottom member 476, is a single member similar to the two bottom members 76 of the triplex receptacle and joined together to form a single member. Member 476 is adapted to fit over the bottom of the two sections of intermediate member 474 and contains six openings for receiving the six contacts of the ground strap 484. Ground strap 484 consists of two sections 486 and 488, each of which is similar to the ground strap 78 of the triplex receptacle and connected together by a conductive bridge. Ground strap 484 supports six ground contacts which are positioned to fit in various openings in the different members of the receptacle which allow the ground contacts to be positioned below openings in the top member 472 designated to receive the half-round blade of a plug which is to be connected to ground. The ground strap 484 supports one screw terminal which can be connected to an electrical ground.

Assembly of the sixplex receptacle is basically similar to the assembly of the triplex receptacle. The main difference is that the assembled sixplex receptacle is connected to two boxes ganged together instead of one box and the alignment plate and wall plate (see FIG. 15) are sized to accommodate the sixplex receptacle. In addition, the various buses and top, intermediate and bottom members of the sixplex receptacle are sized to provide a receptacle having six sockets rather than three sockets.

While there has been shown and described and pointed out the fundamental novel features of the invention as applied to the preferred embodiments, it will be understood that various omissions and substitutions and changes of the form and details of the devices illustrated and in their operation may be made by those skilled in the art without departing from the spirit of the invention.

What is claimed is:

1. A triplex receptacle comprising:

a rectangular body having a top surface;

openings for receiving ground prongs, neutral blades and phase blades of a first, a second and a third plug located in the top surface of said rectangular body;

said openings for said prong and blades of said first plug are at a first end of said top surface;

said openings for said prong and blades of said second plug are at a second end of said top surface;

said openings for said prong and blades of said third plug are located between said openings for said first and said second plug openings;

said neutral and phase blade openings for said first and second plugs are disposed along a first pair of parallel lines, one on each side of said sound prong openings; and said neutral and phase blade openings for said third plug are disposed along a second pair of parallel lines one on each side of said ground prong and at right angles to said first pair of parallel lines.

2. The receptacle of claim 1 wherein the body of the receptacle can be mounted in a single box.

3. The receptacle of claim 2 wherein the openings in the top surface for receiving the blades of said plugs comprises at least two openings for each plug wherein one of the two openings is larger than the other.

4. The receptacle of claim 3 wherein contacts are located behind each opening for receiving the blades of said plugs and wherein the contacts located behind the larger openings are coupled electrically to each other via a bus.

5. The receptacle of claim 4 wherein the contacts located behind each of the smaller openings for receiving the blades of said plugs are coupled electrically to each other via a second bus.

6. The receptacle of claim 3 wherein the openings in the top surface for receiving the blades of said plugs comprises a third opening.

7. The receptacle of claim 6 wherein a contact is located behind each third opening and each contact behind each third opening is coupled electrically to each other and to a contact on the body of the receptacle.

8. The receptacle of claim 7 wherein each third opening in the top surface is a semi-circular opening for receiving a ground prong of a plug.

9. The receptacle of claim 1 wherein the top surface is uninterrupted.

* * * * *